United States Patent [19]

Gach

[11] Patent Number: 4,467,931

[45] Date of Patent: Aug. 28, 1984

[54] TAMPER INDICATING CLOSURE

[75] Inventor: Peter P. Gach, Evansville, Ind.

[73] Assignee: Sunbeam Plastics Corporation, Evansville, Ind.

[21] Appl. No.: 505,794

[22] Filed: Jun. 20, 1983

[51] Int. Cl.[3] ..... B65D 41/62

[52] U.S. Cl. ..... 215/237; 215/250; 220/257; 222/153

[58] Field of Search ..... 215/232, 233, 235, 237, 215/250, 251; 222/153; 220/257, 359

[56] References Cited

U.S. PATENT DOCUMENTS

| | | | |
|---|---|---|---|
| 3,255,915 | 6/1966 | Scholtz | 220/257 |
| 3,391,847 | 7/1968 | Christine et al. | 220/257 X |
| 3,604,585 | 9/1971 | Towns | 215/235 |
| 4,047,643 | 9/1977 | Hazard | 222/153 |
| 4,371,095 | 2/1983 | Montgomery et al. | 222/153 |

*Primary Examiner*—Donald F. Norton

*Attorney, Agent, or Firm*—Fisher, Crampton, Groh & McGuire

[57] ABSTRACT

A tamper indicating dispensing closure for containers in which a cylindrical cap has a passage for dispensing the contents of the container and the passage is closed by a member requiring movement relative to the remainder of the cap. The entire top of the cap is covered by a tamper indicating element which is permanently attached to the remainder of the cap so that the element must be removed in order to perform the opening operations of the closure and such removal results either in the destruction of the element or in the means fixing it to the cap to visually indicate that the closure has been opened or placed in a condition for opening.

20 Claims, 6 Drawing Figures

TAMPER INDICATING CLOSURE

This invention relates to tamper indicating closures and particularly to closures of the dispensing type which are attached to containers from which the contents can be removed through a passage in the closure.

A large variety of dispensing closures have been provided which are intended to be used for containers from which the contents are removed through the closure itself. Among the types of dispensing closures are those in which a portion is lifted to expose a passage or to form a pouring spout or in which a portion is pressed to expose a lifting tab by which a pouring passage can be opened.

An example of the last mentioned type of dispensing closure is disclosed in U.S. Pat. No. 4,371,095 for "One Piece Child Resistant Closure".

It would be highly desirable to make such closures tamper indicating by which any attempt to open a container would make it apparent from visual observation that the container once was opened or that an effort had been made to open it.

For this purpose, a tamper indicating dispensing closure is provided in the form of a cylindrical cap adapted for permanent attachment to a container in which the cap has a passage communicating with the container through which the contents can be dispensed. The passage is closed in a manner which requires movement of means such as a hinged or pivoted plug, cap, or spout. Such movement displaces a portion of the closure above the normal level and the cylindrical cap is covered by a tamper indicating element which is fixed to the cap to cover the movable means and to obstruct its movement from its closed to an open position. The tamper indicating element must be removed by breaking it or portions of the cap to which it is attached. The tamper indicating element can be made of foil which is subject to tearing or of plastic material held on the cap by rivets which must be broken for removal. Once the tamper indicating element is removed, the closure can be operated to open the passage and dispense the contents of the container with which the closure is used. The absence or damage of the tamper indicating element gives evidence that tampering has occurred.

Preferred embodiments of the invention are disclosed in the drawings in which.

A tamper indicating dispensing closure embodying the invention is designated generally at 10 and is intended to be permanently attached to a container 12. The closure 10 is more fully disclosed in previously mentioned U.S. Pat. No. 4,371,095.

Figure 1:
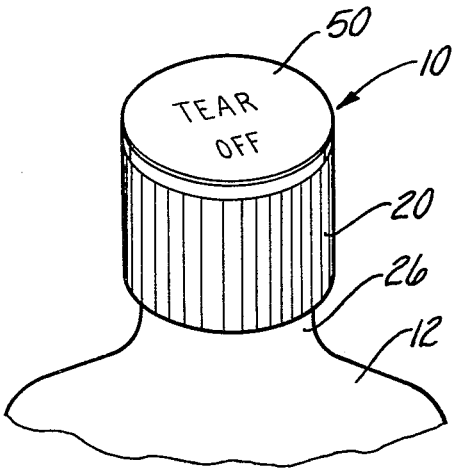
FIG. 1 is a perspective view of a tamper indicating dispensing closure embodying the invention.
Figure 2:
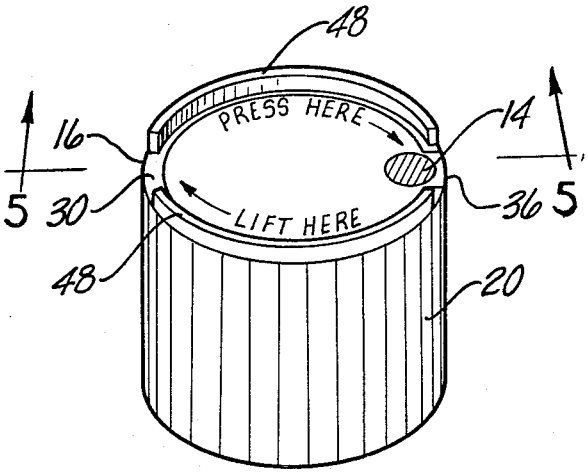
FIG. 2 is a perspective view of the closure in FIG. 1 placed in condition for opening.

The closure 10 is of the press and lift type in which the application of pressure at a specific point designated at 14 in FIG. 2 causes an opposite edge 16 to be exposed so that it can be gripped and lifted to open the closure 10.

Figure 5:
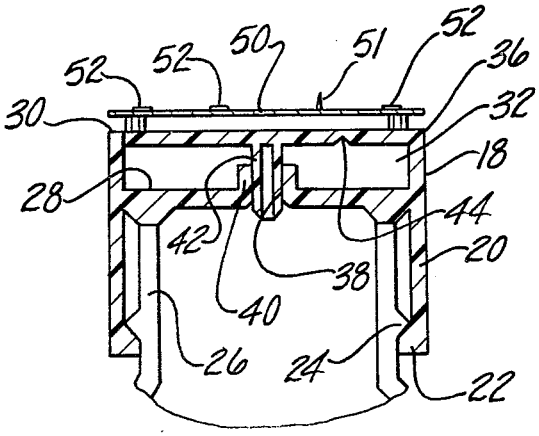
FIG. 5 is a cross sectional view of the dispensing closure seen in FIGS. 1 and 2 taken generally on line 5—5 in FIG. 2.

The closure 10 includes a generally cylindrical cap 18 have a depending skirt 20, the lower edge of which is provided with a bead 22 complementary to an annular flange 24 formed on the neck 26 of the container 12 as best seen in FIG. 5. The cap 18 has a generally disc shaped flat wall 28 disposed below the upper lip 30 at the top of the cylindrical skirt 20. The wall 28 forms a recess 32 closed by a cover member 34 which is hinged along one edge at 36 for swinging movement from the position illustrated in FIG. 5 through an intermediate position illustrated in FIG. 6.

The wall 28 of the cap 18 is provided with a dispensing orifice or passage 38 formed in an annular collar 40 projecting above the top of the wall 28. The orifice 38 is adapted to be closed by a plug 42 formed integrally with the cover member 34 so that in the closed position of the closure 10, the plug 42 is disposed in orifice 38.

Figure 6:
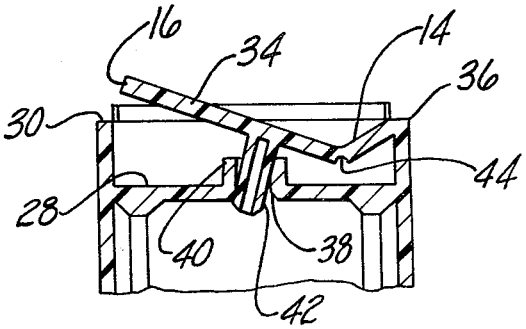
FIG. 6 is a cross sectional view similar to FIG. 5 showing one of the positions during the opening operation of the closure.

The cover member 34 is foldable along a groove 44 which forms a hinge permitting folding of the cover member 34 as seen in FIG. 6.

In the closed position of the closure 10 as seen in FIG. 5, the cover member 34 is coextensive or flush with the top of the cap 18. To open the closure 10, it is necessary first to place the closure in an opening condition by pressing the cover member 34 at point 14 seen in FIG. 2. Point 14 is directly over the hinge line 44 and pressure causes the cover member 34 to fold to lift the edge 16 of the cap 18 above the level of the upper lip 30 as seen in FIG. 6. This permits the edge 16 of the cover member 32 to be grasped to swing the cover member 34 about hinge 36 to remove the plug 42 from the passage 38 to permit dispensing of the contents of the container 12.

Figure 4:
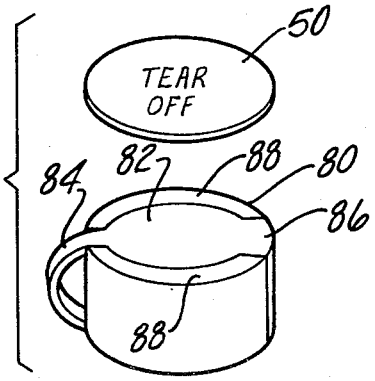
FIG. 4 is a view similar to FIG. 3 showing still another form of dispensing closure.

As seen in FIGS. 2, 4, and 6, the cylindrical cap 18 is provided with pads 48 slightly elevated above the top of the cap 18 and disposed on the lip 30 to extend around a substantial portion of the perimeter of the cap except for those portions at the hinge 36 and at the lift edge 16. The pads 48 provide a location for attachment of a tamper indicating element of foil, plastic or other material. The tamper indicating element 50 is permanently attached to the pads 48. Such attachment can be accomplished by pressure sensitive adhesive or by induction heating a coated foil disc 50 to fuse the coating with the pads 48.

Still another method of attaching the tamper indicating element 50 to the pads 48 is illustrated in FIG. 5. At the time of molding the closure 10 which is made in a single piece of plastic material, prong elements 51, one of which is shown, are molded in spaced locations on the top of the pads 48. The projections 51 pass through the tamper indicating element 50 and are subsequently upset to form rivets 52. The rivets 52 form a permanent mechanical attachment which requires tearing away or breaking of the tamper indicating element 50 or breaking of the rivets 52 to accomplish removal.

Opening of the closure 10 requires movement of the lift edge 16 to a position above the normal elevation of the cap as illustrated in FIG. 6 and such movement cannot be accomplished without breaking or removing the tamper indicating element 50. Such breaking, tearing, or removal of the element 50 makes it apparent that the closure 10 has been opened or at least placed in a condition making it possible to be opened. This gives visual evidence to a prospective purchaser or to a merchandiser that tampering has occurred.

If desired, the tamper indicating element 50 can be made of a relatively durable material such as plastic which requires the use of a tool such as a coin or knife blade which is inserted under the tamper indicating element 50 to pry it away from the remainder of the closure. For this purpose, the spaces between the pads 48 at the lift edge 16 or hinge 36 offer a location for insertion of such a tool. When the tamper indicating element 50 is fastened by means of rivets, the tamper indicating element 50 can be made stronger than the rivets so that the latter break away upon prying of the tamper indicating element 50 to cause its removal. With a foil type tamper indicating element and rivets, an attempt to separate the foil from the rivets will result in tearing and therefore tamper indicating.

The tamper indicating element 50 once removed permits the repeated opening and closing of the closure 10.

Figure 3:
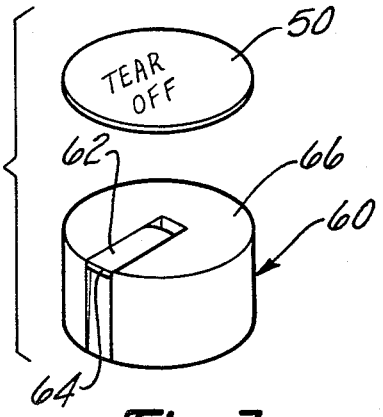
FIG. 3 is an exploded perspective view of another form of dispensing closure.

FIG. 3 illustrates a spout type of dispensing cap 60 with which a tamper indicating element 50 can be used to provide tamper indicating features. The cap 60 is provided with a spout 62 which is moved to a pouring position by lifting on a tab indicated at 64 to raise the spout 62 to a position elevated above the top 66 of the cap 60. The tamper indicating element 50 can be permanently attached to the perimeter of the cap 60 in the same manner as with the embodiment of the invention illustrated in FIGS. 1, 2, 5 and 6, including the formation of rivets.

Use of the spout type closure 60 requires removal of the tamper indicating element by tearing it away or otherwise destroying it or breaking the rivets forming a mechanical connection.

Still another form of closure 80 is seen in FIG. 4. In such a closure, the passage is covered by a cover element 82 held to the remainder of the closure 80 by a strap hinge 84. Opening of such a closure requires lifting on a tab 86 which serves to lift the cover element 82 and expose a passage for dispensing the contents of the container with which the closure 80 is used. The closure 80 can be covered with a tamper indicating element 50 which is attached to circumferential portions 88 of the top to support the element 50 in close proximity to the cover element 82. The tamper indicating element 50 can be attached to the portions 88 of the closure 80 by adhesive, induction heating or mechanically by rivets as with the prior embodiments of the invention. Opening of the closure 80 requires removal of the tamper indicating element which requires its destruction by tearing or breaking away or breaking the mechanical connection if rivets are used, as with the prior embodiments of the invention.

A tamper indicating dispensing closure has been provided in which a cylindrical cap has a generally flat top requiring the moving of closure means from a flush position with the top to a position above the level of the top to obtain access to the container. The movable closure means is covered by a tamper indicating element which must be removed before opening operations can be conducted and such removal requires the element to be broken or destroyed or causes portions formed integrally with the remainder of the cap, such as rivets, for example, to be fractured. The lack of a tamper indicating element gives notice of tampering.

The embodiments of the invention in which an exclusive property or privilege is claimed are defined as follows:

1. A tamper indicating closure comprising: a cap for permanent attachment to a container, said cap having a passage communicating with said container for dispensing the contents thereof, a closure element movable axially relative to said cap between positions opening and closing said passage, a tamper indicating element, and rivet means connected with said cap and passing through openings formed in said tamper indicating element, said tamper indicating element being fixed to said cap in close proximity to said closure element to prevent movement of said closure element.

2. The tamper indicating closure of claim 1 wherein said tamper indicating element is a flat element supported in spaced relationship to the top of said cap to receive a tool for prying said tamper indicating element from said cap, said rivets being weaker than said tamper indicating element to fracture upon prying with said tool.

3. A tamper indicating closure comprising: a cylindrical cap adapted for permanent attachment to a container, a passage in said cap communicating with said container for dispensing the contents thereof, means controlling the opening and closing of said passage in said cap, said means being substantially flush with the top of said cap in a closed position and being swingable above the normal level of the cap to an open position, a tamper indicating element fixed to said cap in close proximity to said means to obstruct movement of said means to its open position.

4. The tamper indicating closure of claim 3 wherein said tamper indicating element is made of a relatively weak material which must be torn away to permit movement of said closure element.

5. The tamper indicating closure of claim 3 wherein means for fixing said tamper indicating element to said cap comprise a bonding agent.

6. The tamper indicating closure of claim 3 wherein said tamper indicating element includes portions fused to said cap.

7. The tamper indicating closure of claim 3 wherein said cap has pad portions elevated above the top of said cap, said tamper indicating element being fixed to said pads.

8. A tamper indicating closure of claim 3 wherein said means is a hinged member.

9. A tamper indicating closure of claim 8 wherein said passage is closed by a closure element on said hinged member.

10. The tamper indicating closure of claim 9 wherein said closure element is a plug.

11. A tamper indicating closure of claim 3 wherein said means controlling said passage is a nozzle pivotal relative to said cap and wherein said passage is formed in said nozzle.

12. The tamper indicating closure of claim 3 in which said tamper indicating element has a substantial portion of its perimeter fused to complementary portions on said cap.

13. The tamper indicating closure of claim 3 wherein said tamper indicating element is supported in spaced relationship to the top of said cap whereby a tool may be inserted in the space for removal of said tamper indicating element from said cap.

14. The tamper indicating closure of claim 3 wherein said passage is closed by a plug, said plug being formed integrally with a hinged member for movement relative to said passage, said tamper indicating element being positioned to interfere with said movement.

15. The tamper indicating closure of claim 3 and further comprising rivet means attached to the top of said cap and passing through openings in said tamper indicating element.

16. The tamper indicating closure of claim 15 wherein said rivet means are spaced at the perimeter of said cap.

17. The tamper indicating closure of claim 15 wherein said tamper indicating element is weaker than said rivet means whereby separation from said rivet means results in rupture of said tamper indicating element.

18. The tamper indicating closure of claim 15 wherein said tamper indicating element is stronger than said rivets whereby separation results in breakage of said rivets to indicate tampering.

19. A tamper indicating closure comprising: a cap adapted for attachment to a container, a passage in said cap communicating with said container for dispensing the contents thereof, means controlling the opening and closing of said passage in said cap, said means being substantially flush with the top of said cap in a closed position and being permanently attached to said cap and swingable above the normal level of the cap to an open position, a tamper indicating element on the top of said cap, and attaching means temporarily holding said tamper indicating element on said cap to prevent swinging movement of said means to said open position until removal of said tamper indicating element from said cap.

20. The tamper indicating closure of claim 19 wherein said attaching means are rivet elements holding said tamper indicating element relative to said cap.

* * * * *